US008087750B2

(12) United States Patent
Ohno et al.

(10) Patent No.: US 8,087,750 B2
(45) Date of Patent: Jan. 3, 2012

(54) LIQUID DROPLET DISCHARGING DEVICE AND IMAGE FORMING DEVICE

(75) Inventors: Kenichi Ohno, Kanagawa (JP); Torahiko Kanda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 395 days.

(21) Appl. No.: 12/393,102

(22) Filed: Feb. 26, 2009

(65) Prior Publication Data

US 2010/0103221 A1 Apr. 29, 2010

(30) Foreign Application Priority Data

Oct. 27, 2008 (JP) ..... 2008-275819

(51) Int. Cl.
*B41J 2/14* (2006.01)

(52) U.S. Cl. ..... 347/47

(58) Field of Classification Search ..... 347/40–43, 347/47, 64–65
See application file for complete search history.

(56) References Cited

U.S. PATENT DOCUMENTS

| | | | |
|---|---|---|---|
| 4,188,635 | A | 2/1980 | Giordano et al. |
| 4,284,993 | A | 8/1981 | Kakeno |
| 5,361,087 | A | 11/1994 | Tajima et al. |
| 5,909,230 | A | 6/1999 | Choi et al. |
| 2006/0098049 | A1 | 5/2006 | Kanda |
| 2006/0098054 | A1 | 5/2006 | Kanda |
| 2009/0237466 | A1 | 9/2009 | Kanda |

FOREIGN PATENT DOCUMENTS

| | | |
|---|---|---|
| JP | 54-55436 | 5/1979 |
| JP | 55-113574 | 9/1980 |
| JP | 04-138255 | 5/1992 |
| JP | 05-031908 | 2/1993 |
| JP | 5-180222 | 7/1993 |
| JP | 06-085066 | 12/1994 |
| JP | 7-32596 | 2/1995 |
| JP | 09-262979 | 10/1997 |
| JP | 2002-248774 | 9/2002 |
| JP | 2006-130780 | 5/2006 |
| JP | 2008-68500 | 3/2008 |
| JP | 2009-139560 | 6/2009 |

*Primary Examiner* — Lamson Nguyen
(74) *Attorney, Agent, or Firm* — Fildes & Outland, P.C.

(57) ABSTRACT

There is provided a liquid droplet discharging device including: a liquid passage member provided with a liquid passage into which a liquid is supplied; plural nozzles provided for the liquid passage member and each discharging the liquid contained in the liquid passage; a holding member that holds both end portions of the liquid passage member; and a drive unit that drives at least one of the holding members, and deforms the liquid passage member from a concave state to a convex state in the liquid droplet discharge direction, imparts inertial force to the liquid, and discharges liquid droplets from the nozzles.

12 Claims, 11 Drawing Sheets

LIQUID DROPLET DISCHARGING DEVICE AND IMAGE FORMING DEVICE

CROSS-REFERENCE TO RELATED APPLICATION

This application is based on and claims priority under 35 USC 119 from Japanese Patent Application No. 2008-275819 filed on Oct. 27, 2008.

BACKGROUND

Technical Field

The present invention relates to a liquid droplet discharging device and an image forming device.

SUMMARY

According to an aspect of the invention, there is provided a liquid droplet discharging device including:

a liquid passage member provided with a liquid passage into which a liquid is supplied;

plural nozzles provided for the liquid passage member and each discharging the liquid contained in the liquid passage;

a holding member that holds both end portions of the liquid passage member; and a drive unit that drives at least one of the holding members, and deforms the liquid passage member from a concave state to a convex state in the liquid droplet discharge direction, imparts inertial force to the liquid, and discharges liquid droplets from the nozzles.

BRIEF DESCRIPTION OF THE DRAWINGS

Exemplary embodiments of the present invention will be described in detail based on the following figures, wherein.

DETAILED DESCRIPTION

An ink-jet recording device that serves as an image forming device according to an embodiment of the present invention will be schematically described.

(Ink-Jet Recording Device)

Figure 1:
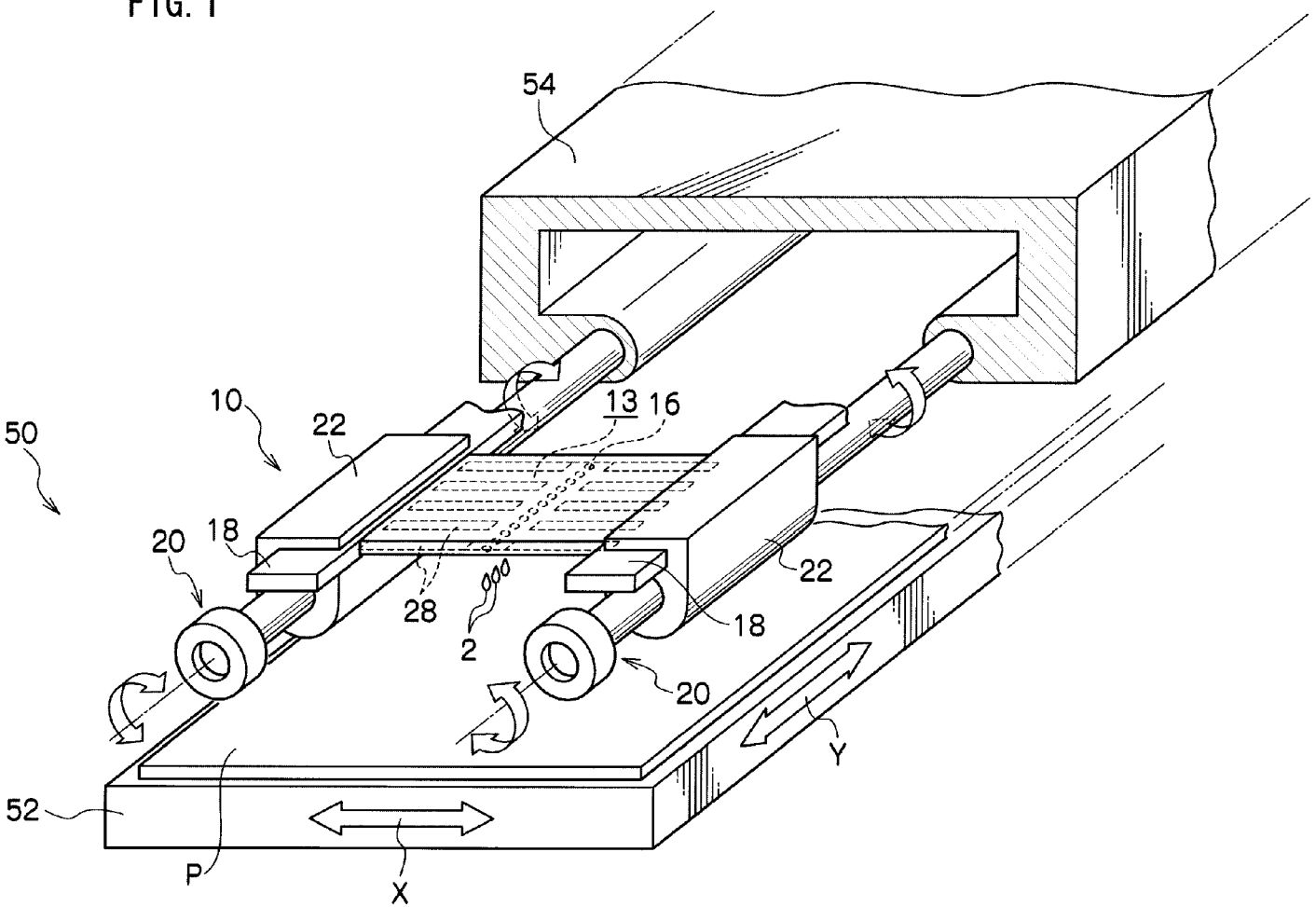
FIG. 1 is a perspective view showing an ink-jet recording device according to an embodiment of the present invention.

FIG. 1 shows an ink-jet recording device equipped with an ink-jet recording head serving as a liquid droplet discharging device according to an embodiment of the present invention. As shown in FIG. 1, an ink-jet recording device 50 is equipped with a head supporting member 54, so that an ink-jet recording head 10 can be held thereby as described later.

The head supporting member 54 has a structure formed so as not to prevent an ink discharge operation of the ink-jet recording head 10 (that is, a structure in which an ink flow passage member 12 and a beam member 14, which are described later, do not interfere with each other), and a table (a conveying unit) 52 that conveys a recording medium P is provided below the head supporting member 54.

The table 52 can be moved on the same plane in both directions indicated by the double-headed arrows X and Y in FIG. 1. For example, when an image is formed on the recording medium P, the recording medium P is placed on the table 52, and ink is discharged from the ink-jet recording head 10, and the table 52 is moved in the both directions indicated by the double-headed arrows X and Y. There are cases in which movement of the table 52 at least in the directions indicated by the double-headed arrow Y may not be required depending on the size of the ink flow passage member 12.

(Ink-Jet Recording Head)

Figure 2A:
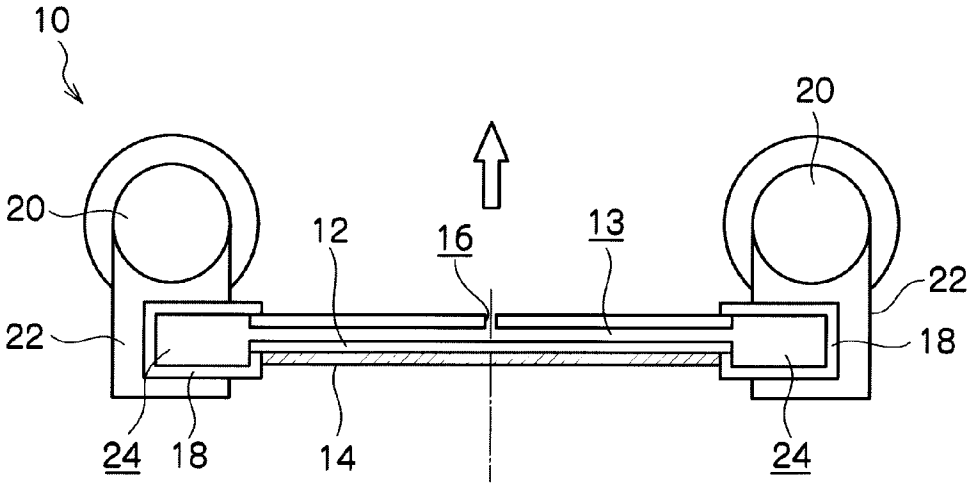
FIG. 2A is a cross-sectional view showing an ink-jet recording head according to the embodiment of the present invention.
Figure 2B:
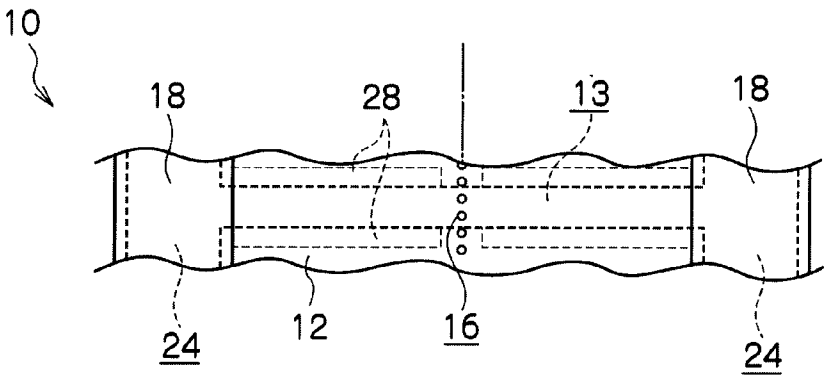
FIG. 2B is a plan view showing an ink-jet recording head according to the embodiment of the present invention.

The ink-jet recording head 10 is described hereinafter. As shown in FIG. 1 and FIGS. 2A and 2B (for convenience of explanation, the ink-jet recording head 10 is made upside down in FIGS. 2A and 2B contrary to FIG. 1), the ink-jet recording head 10 has a structure that the ink passage member 12 (described later) having an ink passage 13 therein and also having nozzles 16 at the central portion thereof, and the beam member 14 that supports the ink passage member 12 are bonded together, thereby both ends of the inkjet recording head 10 to be supported by holding members 18, respectively. The holding members 18 each have an ink pool 24 that connects to the ink passage 13, and ink supplied from then ink pool 24 passes through the ink passage 13 and arrives at the nozzles 16.

A rotating encoder (drive unit) 20 is supported by the head supporting member 54 in a rotatable manner, and the holding member 18 is fixed in an arm 22 provided in the rotating encoder 20. The ink passage member 12 and the beam member 14 are each made from elastically-deformable material, and due to rotation of the rotating encoder 20, the ink passage member 12 can be bent and deformed via the arm 22 and the holding member 18 in the ink discharge direction (i.e., the direction indicated by the arrow shown in FIG. 2A) and also in the direction opposite to the ink discharge direction (hereinafter referred to merely as "opposite direction").

The case in which the ink passage member 12 and the beam member 14 are bent and deformed in the ink discharging direction means that the ink passage member 12 and the beam member 14 are made convex in the ink discharge direction, and the case in which the ink passage member 12 and the beam member 14 are bent and deformed in the opposite direction means that the ink passage member 12 and the beam member 14 are made concave in the ink discharge direction.

Further, the holding member 18 is disposed at a position that is offset from the rotational center of the rotating encoder 20 by the length of the arm 22 (in this case, 2.5 mm). Due to rotation of the rotating encoder 20, bending stress, as well as pressing force from the holding member 18 (compressive force) acts on the ink passage member 12 and the beam member 14.

Then, due to the ink passage member 12 being bent and deformed in the ink discharge direction and also in the opposite direction, inertial force is applied to the ink within the ink passage member 13. When the ink passage member 12 is bent and deformed in the ink discharge direction from the opposite direction, ink droplets are discharged from the nozzles 16.

Next, the operation of the ink passage member 12 is described.

Figure 3A:
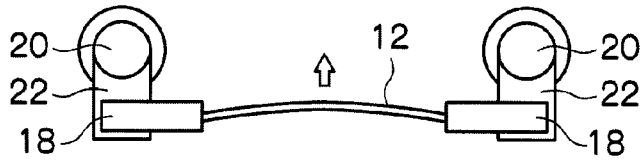
FIG. 3A is a diagram showing an operation of the ink-jet recording head according to the embodiment of the present invention.

As shown in FIG. 3A, in a state in which the angle of the rotating encoder 20 is set to be 0 degree, the ink passage member 12 (and the beam member 14) are brought into a state of being bent in the ink discharge direction (the direction indicated by the arrow) in advance. From the aforementioned state, as shown in FIG. 3B, the rotating encoder 20 is rotated in the normal direction (in the direction indicated by arrow A).

Figure 3B:
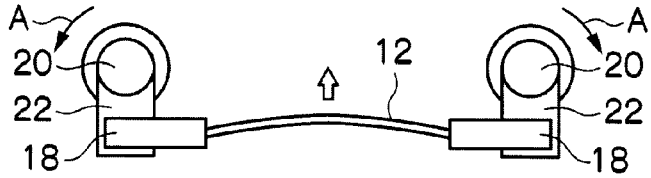
FIG. 3B is a diagram showing an operation of the ink-jet recording head according to the embodiment of the present invention.
Figure 3C:
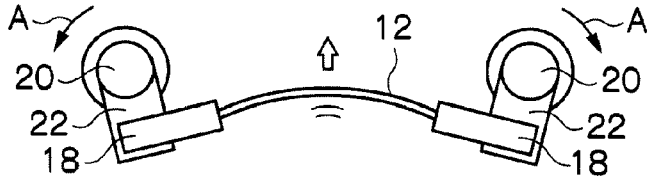
FIG. 3C is a diagram showing an operation of the ink-jet recording head according to the embodiment of the present invention.
Figure 3D:
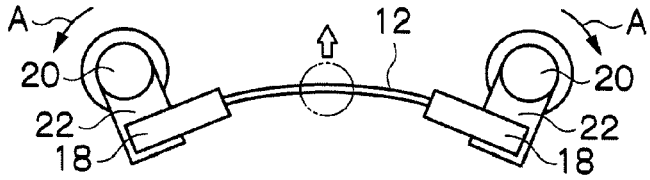
FIG. 3D is a diagram showing an operation of the ink-jet recording head according to the embodiment of the present invention.

For example, when the rotating encoder 20 is rotated in the range of 0 degree to +20 degrees, as shown in FIGS. 3B to 3D, the ink passage member 12 is continuously bent in the ink discharge direction, and remains convex in the ink discharge direction until it is bent to the maximum as shown in FIG. 3D.

Figure 3E:
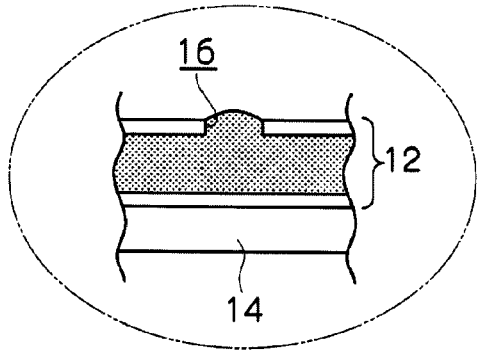
FIG. 3E is a partially enlarged view of FIG. 3D.

In other words, during a period in time that the ink passage member 12 is displaced from the state shown in FIG. 3A to the state shown in FIG. 3D, ink contained in the ink passage member 12 is not influenced by sufficient acceleration in the discharge direction. Therefore, there is no possibility that ink droplets may be discharged from the nozzles 16 (see the enlarged view of FIG. 3E).

Figure 4A:
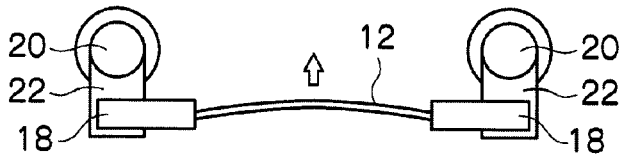
FIG. 4A is a diagram showing an operation of the ink-jet recording head according to the embodiment of the present invention.
Figure 4B:
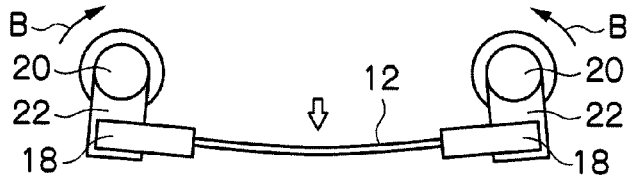
FIG. 4B is a diagram showing an operation of the ink-jet recording head according to the embodiment of the present invention.

When the rotating encoder 20 is rotated in the opposite direction (the direction indicated by arrow B), for example, −5 degrees as shown in FIG. 4B, from the state in which the ink passage member 12 is in advance bend in the ink discharge direction (the direction indicated by the arrow) as shown in FIG. 4A, the ink passage member 12 changes to bend from the convex state to the concave state with respect to the ink discharge direction.

Figure 4C:
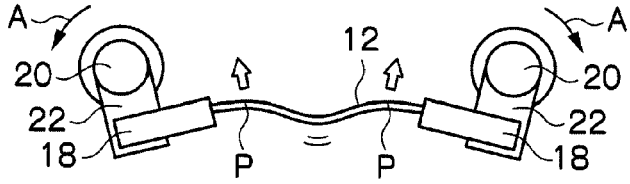
FIG. 4C is a diagram showing an operation of the ink-jet recording head according to the embodiment of the present invention.

In the aforementioned state, the rotating encoder 20 is rotated again in the normal direction (the direction indicated by arrow A), for example, 20 degrees, compressive force and bending stress act on the ink passage member 12, and as shown in FIG. 4C, the portions of the ink passage member 12 at the sides of the rotating encoders 20 are deformed in the ink discharge direction, i.e., the direction indicated by the arrow (so-called inflection points P).

Figure 4D:
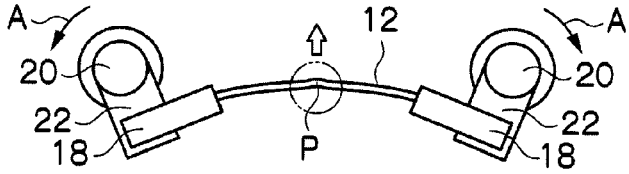
FIG. 4D is a diagram showing an operation of the ink-jet recording head according to the embodiment of the present invention.
Figure 4E:
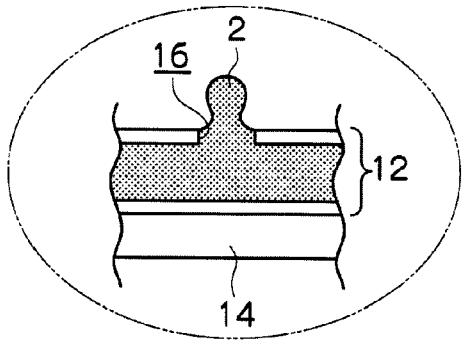
FIG. 4E is a partially enlarged view of FIG. 4D.

These inflection points P each move, as shown in FIGS. 4C and 4D, from the side of the rotating encoder 20 to the central portion of the ink passage member 12. When the inflection points P arrive at the central portion of the ink passage member 12, the ink passage member 12 deforms steeply in the ink discharge direction, i.e., the direction indicated by the arrow (so-called buckling inversion).

The nozzle 16 is provided at the central portion of the ink passage member 12. Therefore, the ink that arrives at the nozzle 16 is subjected to a large inertial force accompanied by deformation of the ink passage member 12 in the ink discharge direction, which is caused by the buckling inversion. As a result, the ink is discharged, as an ink droplet 2, from the nozzle 16.

The deformation speed of the ink passage member 12 due to the buckling inversion becomes larger compared with displacement caused by an ordinary actuator such as a piezoelectric element. Thus, the range of viscosity of ink to be dischargeable becomes wide.

Figure 5:
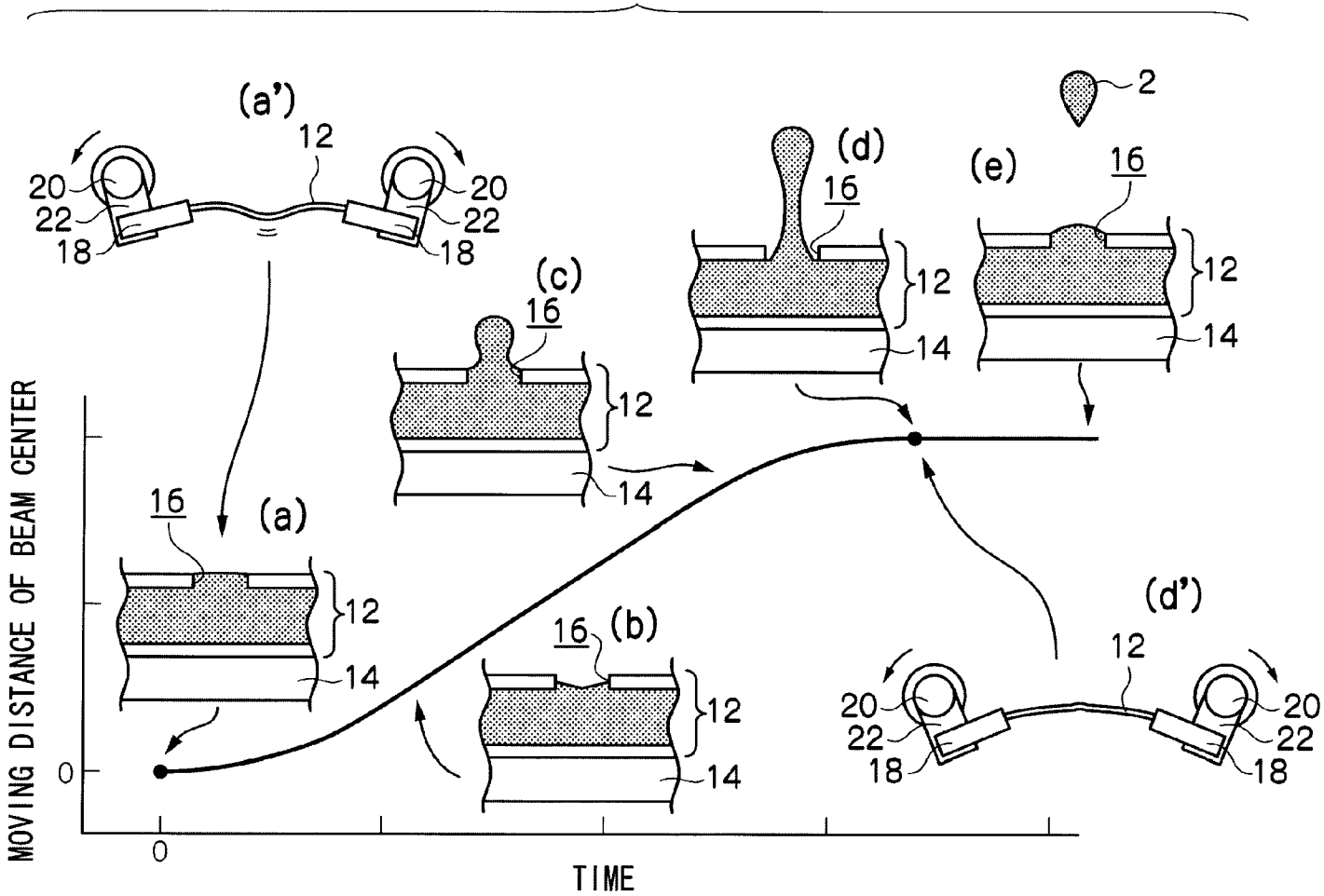
FIG. 5 is a diagram showing the relationship between displacement of a central portion of a beam member of the ink-jet recording head according to the embodiment of the present invention, and discharge of an ink droplet.

The relationship between the displacement of the ink passage member 12 (the central portion of the beam member 14) from the state shown in FIG. 4C to the state shown in FIG. 4D, and discharge of the ink droplet 2, is shown in FIG. 5.

FIG. 5 shows changes in movement of the ink passage member 12 and the beam member 14 in the vicinity of the nozzle 16 from just before the ink passage member 12 undergoes buckling inversion until just after the ink droplet is discharged, with the passage of time.

Just before the ink passage member 12 and the beam member 14 would undergo buckling inversion (a'), these members are substantially placed in a stationary state with respect to the ink discharge direction, and the liquid surface of the ink in the nozzle 16 does not change (a). However, when the buckling inversion of the ink passage member 12 and the beam member 14 begins to occur (b), these members steeply start to move in the discharge direction. Therefore, the ink is brought into a state of being pressed due to inertial force thereof in the opposite direction, and the ink surface in the nozzle 16 is made concave on the inward side.

In the aforementioned sate, the ink passage member 12 and the beam member 14 continue to deform due to buckling inversion thereof, and subsequently, the displacement speed of the ink passage member 12 and the beam member 14 in the discharge direction begins to decrease just before the amount by which the ink passage member 12 and the beam member 14 deform become maximum (c). However, the ink in the ink passage member 12 is about to move in the discharge direction at the uniform velocity due to the inertial force of the ink, and therefore, the ink droplet 2 begins to protrude from the nozzle 16 due to the speed difference between the displacement of the ink passage member 12 and the ink.

If the amount by which the ink passage member 12 and the beam member 14 deform becomes maximum, the displacement in the discharge direction stops (d'), and therefore, only the ink droplet 2 protrudes from the nozzle 16 (d), and the ink droplet 2 is ejected in the discharge direction by the inertia thereof (e).

The displacement of the ink passage member 12 and the beam member 14 from the state (a) to the state (e) due to the buckling inversion thereof occurs over an extremely short period of time. Therefore, even if the viscosity of the ink is high, excellent discharging property is obtained. Further, in this case, the rotating encoders 20 are provided in the holding members 18, respectively, but the rotating encoder 20 may also be provided in only one of the holding members 18.

The ink used herein is a high viscosity ink which is specifically far exceeding 10 cps (for example, 50 to 100 cps) having an extremely high ink viscosity for the purposes of preventing ink blur when ink lands on a recording medium, increasing optical color density, achieving swell-restriction/short-time drying of the medium due to reduction of the amount of water, or increasing the degree of freedom in totalized design of such high-quality ink. Due to the high viscosity ink being used, blur of the ink droplet 2 when the ink lands on the recording medium P is restrained, thereby allowing high quality recording.

The outline of the ink-jet recording head 10 according to the present embodiment is described hereinafter.

Figure 6:
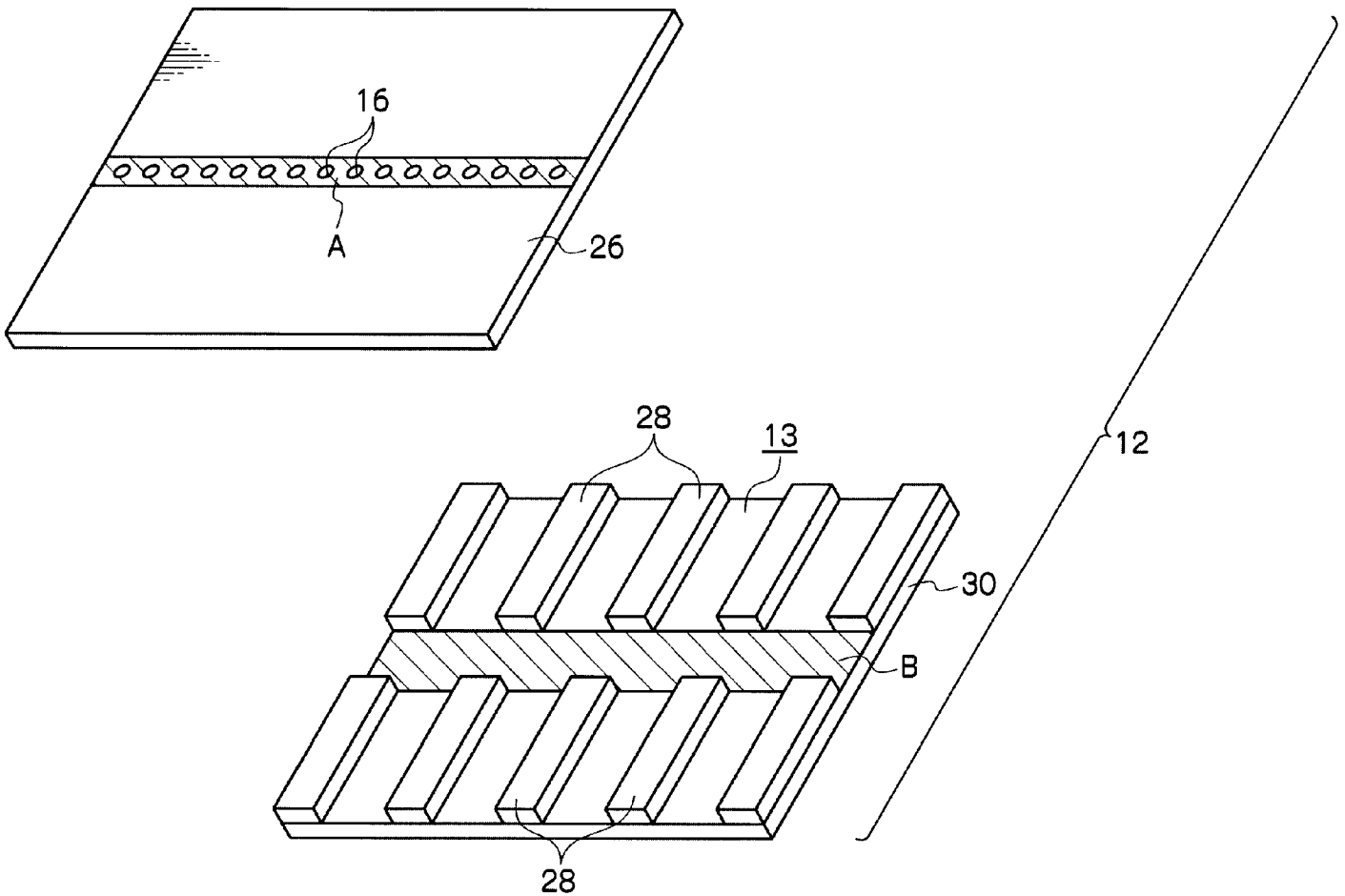
FIG. 6 is an exploded perspective view showing an ink flow passage member of the ink-jet recording head according to the embodiment of the present invention.

The ink passage member 12 is equipped with a nozzle plate 26 having plural nozzles 16 formed therein, and a passage plate 30 in which plural partition walls 28 causing the ink passage 13 to be divided are formed as shown in FIG. 6. The nozzle plate 26 and the passage plate 30 are bonded together and the ink flows in the ink passage 13.

The partition walls 28 each extend in a direction perpendicular to the direction in which the ink pool 24 (see FIG. 2B) extends, and the plural nozzles 16 are made to correspond to one ink passage 13. As a result, as compared to a case in which only one nozzle 16 is provided for one ink passage 13, the number of partition walls 28 can be reduced, and high density nozzle arrangement is achieved correspondingly.

Further, the central portions of the partition walls 28 in the extending direction are segmented and the segmented region B is thereby formed. In the segmented region B, the ink passages 13 are brought into a state of connecting to each other. In other words, plural nozzles 16 are formed at the central portion of the ink passage member 12 (the nozzle plate 26), but no partition wall 28 is provided in the region A having these nozzles 16 formed therein. Incidentally, the partition walls 28 provided at both end portions of the passage plate 30 along the direction in which the ink pools 24 extend are not divided.

In the aforementioned state, the nozzles 16 are formed and arranged in one row so as to face the segmented region B, but these nozzles 16 are continuously formed at predetermined intervals irrespective of pitches between the partition walls 28 of the nozzles 16. When the segmented region B of the partition walls 28 is made to correspond to the region A having the nozzles 16 formed therein as described above, as compared to a case in which no partition walls 28 are divided, the degree of freedom of the nozzle arrangement is increased, and high density nozzle arrangement is obtained. That is to say, since the number of the nozzles 16 increases, the number of droplets ejected per unit time increases. Particularly, the case in which a film is formed on a recording medium by the ink-jet recording head 10 is effective.

Further, after liquid droplets are discharged, it is necessary that ink is again drawn in the nozzles in a short period of time so that the meniscus is restored in an initial state (so-called refill behavior). However, ink flows through each of the ink passages 13 until it arrives at the segmented region B of the partition walls 28, and therefore, the ink passages have the same length in each of the nozzles 16, so that the refill behavior is made uniform.

Due to the region A having the nozzles 16 formed therein being formed so as to extend along the segmented region B of the partition walls 28, that is, in the direction perpendicular to the flowing direction of the ink, the difference in the ink flowing velocity between the nozzles 16 becomes smaller compared to a case in which no segmented region B is provided. For this reason, the difference in the discharged state of the ink droplets caused by the difference in the flowing velocity of ink becomes lessened.

In this case, the nozzle plate 26 is formed by using a polyimide film whose thickness is 25 μm, and the plural nozzles 16 are formed by drilling along a direction perpendicular (crossing) to the ink flowing direction by means of laser beam machining.

Further, a resin film whose thickness is 50 μm is used as the passage plate 30, and the ink passages 13 are patterned by means of photolithography. Using an epoxy adhesive, the nozzle plate 26 is bonded to the passage plate 30, and subsequently, the beam member 14 available from SUS Corporation and having a thickness of 20 μm is bonded to the passage plate 30.

In the aforementioned case, the laser beam machining is used for processing the nozzles 16, but the present invention is not limited to the same. The nozzles may also be formed by means of etching (high accuracy), press working (high efficiency), or blast finishing.

Figure 7:
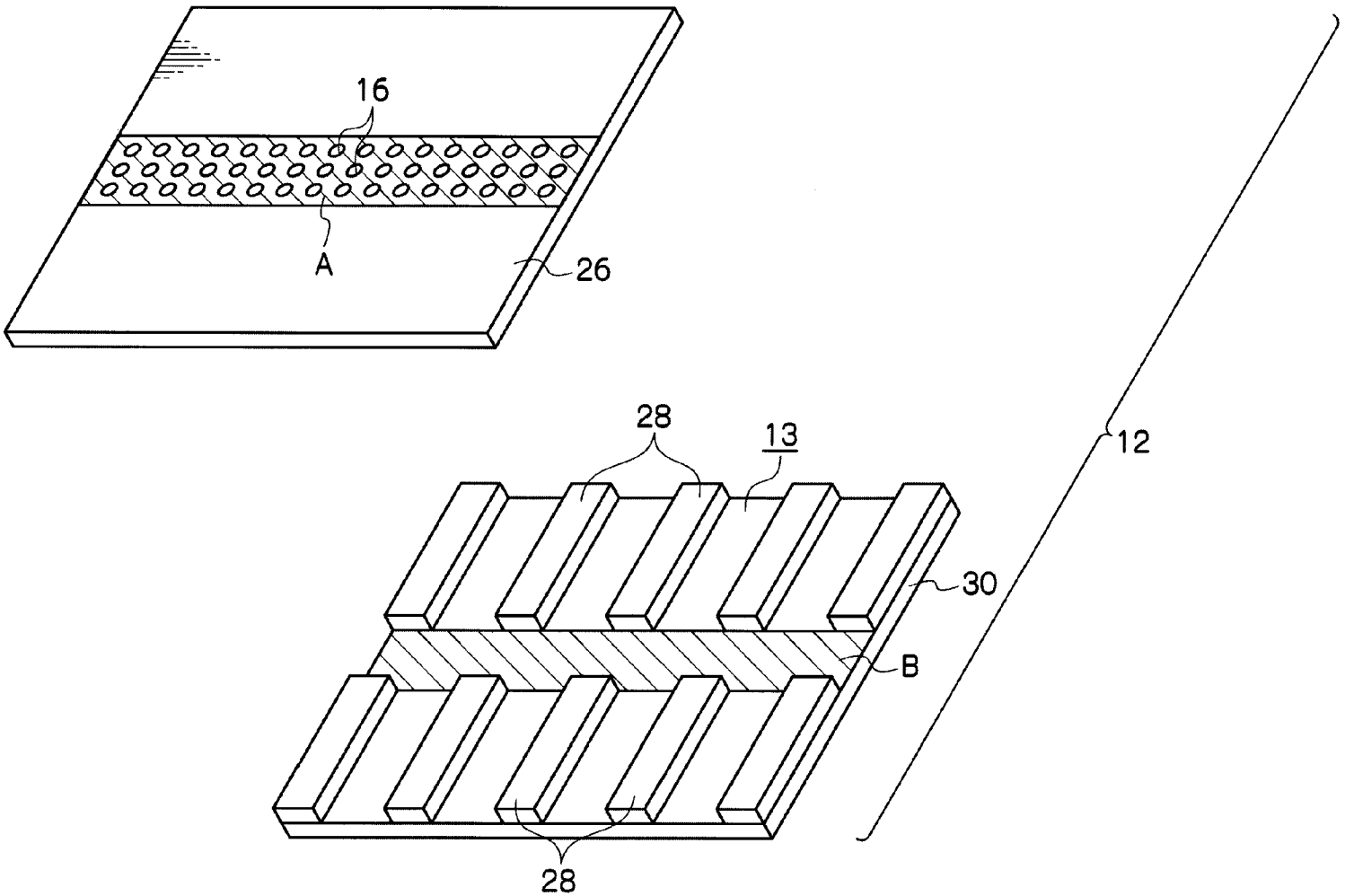
FIG. 7 is an exploded perspective view showing a first modified example of the ink flow passage member of the ink-jet recording head according to the embodiment of the present invention.

Further, in the aforementioned case, one row of nozzles 16 is provided along the direction perpendicular to the ink flowing direction, but as shown in FIG. 7, plural rows of nozzles (in this drawing, three rows of nozzles) may also be provided. As a result, as compared to the case in which one row of nozzles 16 is provided, the number of droplets ejected per unit time increases. Moreover, in this case, the segmented region B of the partition walls B becomes larger in response to the region A having the nozzles 16 formed therein.

Figure 8:
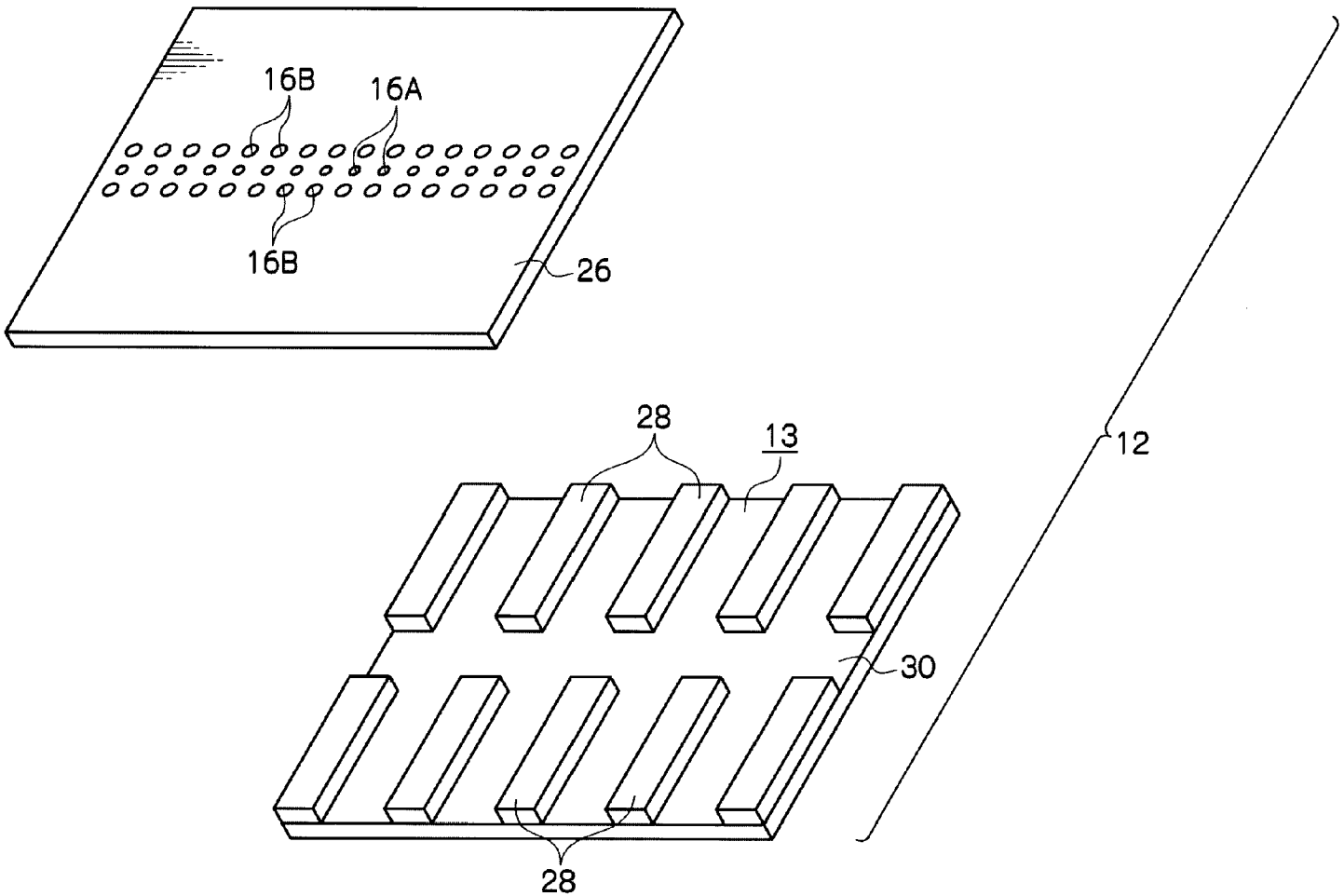
FIG. 8 is an exploded perspective view showing a second modified example of the ink flow passage member of the ink-jet recording head according to the embodiment of the present invention.

As previously described, the buckling inversion of the ink passage member 12 largely occurs at the central portion of the ink passage member 12. That is to say, the inertial force acting on the ink becomes maximum at the central portion of the ink passage member 12. Accordingly, in the case in which the plural nozzles 16 are provided, the pore size of the nozzles 16A in the middle row may be made smaller than that of the nozzles 16B in the outer rows thereof, as shown in FIG. 8, depending on ink viscosity and other conditions.

Figure 9:
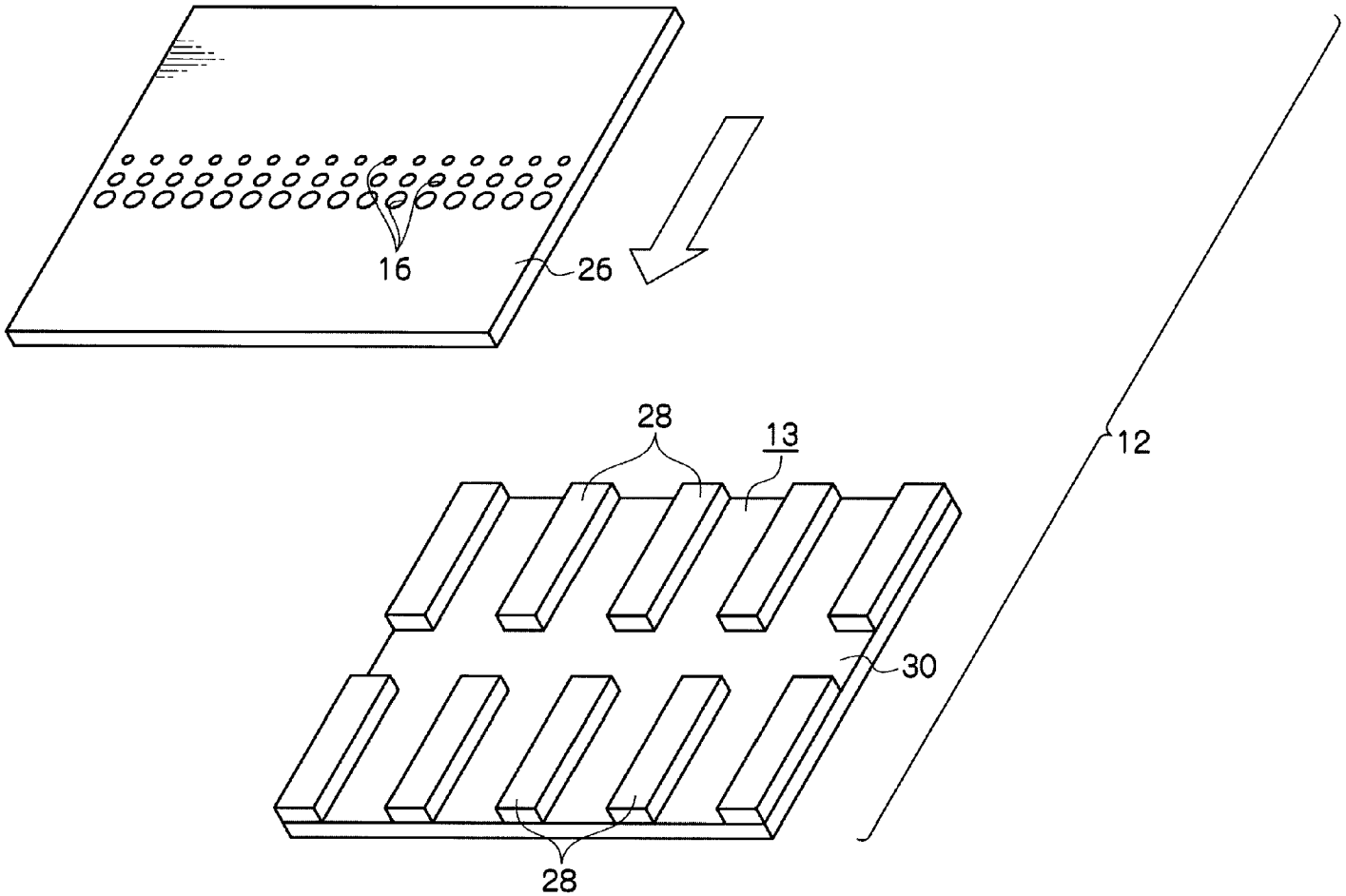
FIG. 9 is an exploded perspective view showing a third modified example of the ink flow passage member of the ink-jet recording head according to the embodiment of the present invention.

Further, in addition to the aforementioned structure, the inner diameter of the nozzles 16 may also be varied in conformity to the ink flowing direction. After the liquid droplets are discharged, it is necessary that ink is again drawn in the nozzles in a short period of time so that the meniscus is restored to an initial state (so-called refill behavior). Therefore, if ink is filled just before the ink flowing direction, a large amount of ink needs to be fed rearward in the ink passage 13. For this reason, as shown in FIG. 9, the pore size of the nozzles 16 is made larger along the ink flowing direction (the direction indicated by the arrow) in the ink passage 13.

Figure 10:
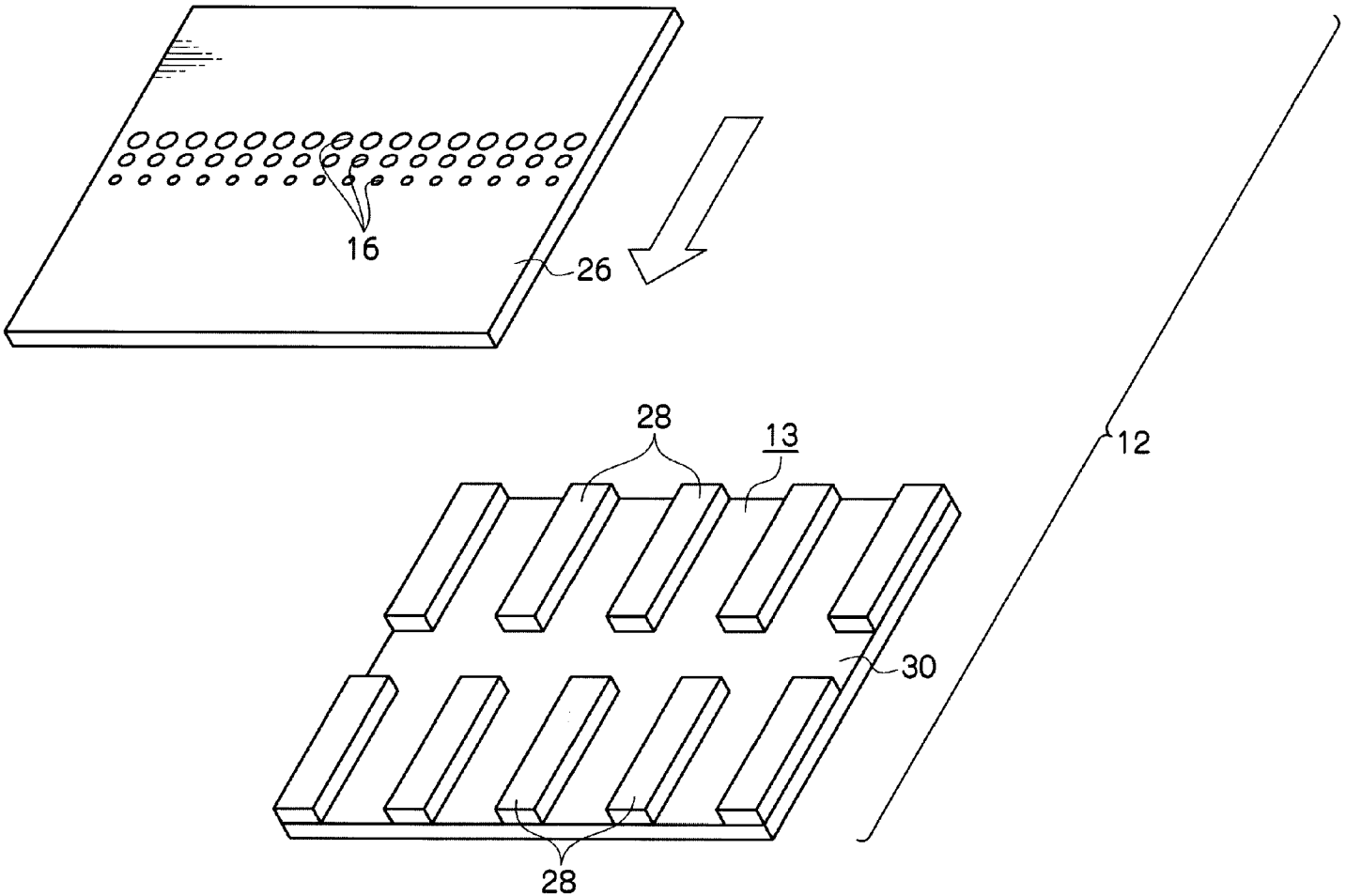
FIG. 10 is an exploded perspective view showing a fourth modified example of the ink flow passage member of the ink-jet recording head according to the embodiment of the present invention.

Moreover, in a case in which ink is not immediately filled in the nozzles at the upstream side of the ink flowing direction (the direction indicated by the arrow), the pore size of the nozzles 16 is made smaller along the ink flowing direction in the ink passage 13, as shown in FIG. 10, so as to lessen a time lag between the time when ink is filled in the nozzles at the downstream side of the ink passage 13 and the time when ink is filled in the nozzles at the upstream side of the ink passage 13.

Figure 11C:
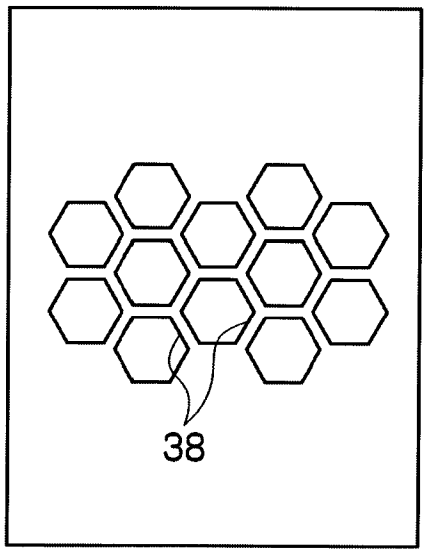
FIG. 11C is a diagram showing still another modified example of the nozzle shape of the ink-jet recording head according to the embodiment of the present invention.

In the aforementioned cases, the shape of the nozzles 16 is made circular, but the nozzles may also be made in the form of a polygon. For example, as shown in FIG. 11A, nozzles 34 having a triangular configuration are formed, and respective bottom sides of the triangular nozzles may be disposed alternately, so as to narrow the intervals between the nozzles 34. As a result, the triangular nozzles allow achievement of the nozzle arrangement having a higher density as compared to the nozzle arrangement having circular nozzles 16.

Figure 11B:
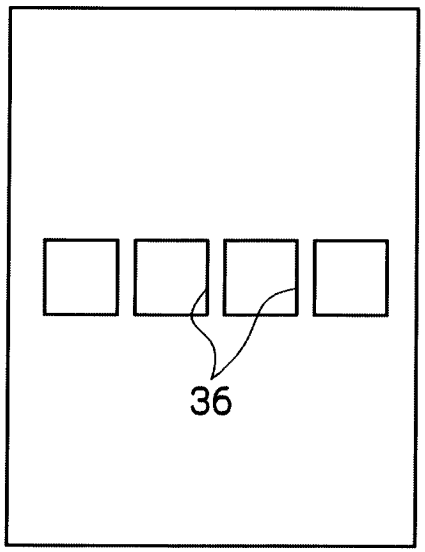
FIG. 11B is a diagram showing another modified example of the nozzle shape of the ink-jet recording head according to the embodiment of the present invention.
Figure 11A:
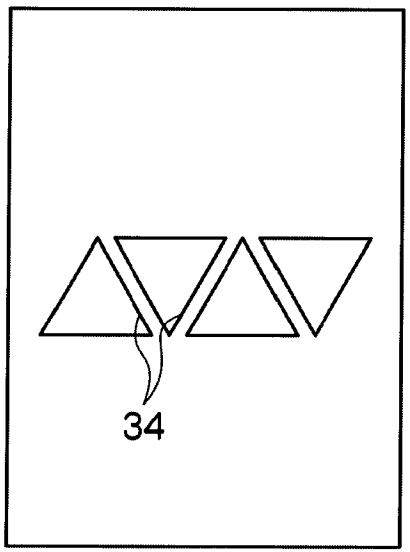
FIG. 11A is a diagram showing a modified example of a nozzle shape of the ink-jet recording head according to the embodiment of the present invention.

In addition, as shown in FIG. 11B, square nozzles 36 may also be formed so as to narrow the spaces between the nozzles 36. Furthermore, as shown in FIG. 11C, hexagonal nozzles 38 are formed, and are disposed in an alternate manner so that the nozzles may be arranged in plural rows.

On the other hand, the rotating encoder 20 and the holding member 18 are bonded to each other in such a manner that the holding member 18 is offset a distance of 2.5 mm from the rotational center of the rotating encoder 20, and when the ink is discharged (when the ink passage member 1 is made to undergo buckling inversion), the rotating encoder 20 is rotated in the range of −5 degrees to +20 degrees. At this time, the beam member 14 and the central portion of the passage member 12 moves a distance of 1 mm in the ink discharge direction at the speed of about 10 m/s. Ink prepared by increasing the mixing ratio of glycerin to have a viscosity of 50 cps is discharged from the nozzle 16 as the ink droplet 2 whose diameter is about 25 μm, and ink prepared by increasing the mixing ratio of glycerin to have a viscosity of 100 cps is discharged from the nozzle 16 as the ink droplet 2 whose diameter is about 20 μm.

The discharge test is driven in the discharge cycle of 3 Hz, and the ink droplet 2 is observed by a stroboscopic method. Incidentally, if the rotation angle of the rotating encoder 20 is increased from −5 degrees to +30 degrees, the amount of ink to be discharged increases, and the ink having a viscosity of 50 cps is discharged as the ink droplet 2 whose diameter is about 30 μm, and the ink having a viscosity of 100 cps is discharged as the ink droplet 2 whose diameter is about 25 μm.

The amounts of compression and rotation applied to the beam member 14 and the ink passage member 12, that is, the rotation angle of the rotating encoder 20 can control as to whether the ink droplet 2 is discharged or not (buckling inversion occurs or does not occur). Therefore, the amounts of compression and rotation applied to the beam member 14 and the ink passage member 12 causes the magnitude of inertial force to be applied to the ink, to vary, and the liquid amount of the ink droplet 2 to be discharged can be changed.

In the aforementioned embodiment, the nozzles 16 and the ink passages 13 are bonded together by an adhesive after having formed on separate films, but the present invention is not limited to the same. For example, the nozzles and ink supplying passages may be formed integrally. Alternatively, the beam member 14 may be formed so as to have an integral structure, or it may also have another structure.

Further, in the aforementioned embodiment, recording is carried out in such a manner that the ink-jet recording head 10 is fixed and the recording medium P is being moved (conveyed). However, for example, recording may be carried out, with the recording medium P being fixed, while the ink-jet recording head 10 mounted o a carriage is being conveyed, or recording may also be carried out while the ink-jet recording head and the recording medium are both being conveyed. Alternatively, the structure in which a drum onto which the recording medium P is wound is rotated may also be used.

Moreover, the ink-jet recoding used in the specification shown above is not limited to recording of characters and images on recording paper. That is to say, the recording medium is not limited to paper, and the liquid to be discharged is not limited to ink. For example, the present invention can be utilized in all types of liquid droplet ejection devices for industrial use, such as a device in which ink is discharged on a polymer film or glass, so as to prepare a color filter for display, a device in which liquid-like solder is ejected on a substrate to thereby form a bump for mounting parts, and the like.

What is claimed is:

1. A liquid droplet discharging device comprising:

a liquid passage member provided with a liquid passage into which a liquid is supplied;

a plurality of nozzles provided for the liquid passage member and each discharging the liquid contained in the liquid passage;

holding members that each hold an end portion of the liquid passage member;

a drive unit that drives at least one of the holding members, and deforms the liquid passage member from a concave state to a convex state in the liquid droplet discharge direction, imparts inertial force to the liquid, and discharges liquid droplets from the nozzles; and partition walls used to divide the liquid passage, the partition walls being provided so as to cross an array of the nozzles outside of a region in which the nozzles are formed.

2. The liquid droplet discharging device according to claim 1, wherein the plurality of nozzles are formed along the holding members.

3. The liquid droplet discharging device according to claim 1, wherein an array of nozzles is provided at the center of the liquid passage member.

4. The liquid droplet discharging device according to claim 1, wherein the nozzles are each formed in the shape of a polygon.

5. The liquid droplet discharging device according to claim 1, wherein the plurality of nozzles are arranged in multiple rows.

6. The liquid droplet discharging device according to claim 5, wherein a pore diameter of the nozzles located at the holding member sides of the liquid passage member is made larger than that of the nozzles located at the center of the liquid passage member.

7. An image forming device comprising:

a liquid droplet discharging device including a liquid passage member provided with a liquid passage into which a liquid is supplied, a plurality of nozzles provided for the liquid passage member and each discharging the liquid contained in the liquid passage, holding members that each hold an end portion of the liquid passage member, a drive unit that drives at least one of the holding members, and deforms the liquid passage member from a concave state to a convex state in the liquid droplet discharge direction, imparts inertial force to the liquid, and discharges liquid droplets from the nozzles, and partition walls used to divide the liquid passage, the partition walls being provided so as to cross an array of the nozzles outside of a region in which the nozzles are formed; and a conveying unit that conveys a recording medium to a region into which liquid droplets are discharged from the liquid droplet discharging device.

8. The image forming device according to claim 7, wherein the plurality of nozzles are formed along the holding members.

9. The image forming device according to claim 7, wherein an array of the nozzles is provided at the center of the liquid passage member.

10. The image forming device according to claim 7, wherein the nozzles are each formed in the shape of a polygon.

11. The image forming device according to claim 7, wherein the plurality of nozzles are arranged in multiple rows.

12. The image forming device according to claim 11, wherein a pore diameter of the nozzles located at the holding member sides of the liquid passage member is made larger than that of the nozzles located at the center of the liquid passage member.

* * * * *